US009208700B2

(12) United States Patent
Yano

(10) Patent No.: US 9,208,700 B2
(45) Date of Patent: Dec. 8, 2015

(54) STICKER RECORDING SHEET

(71) Applicant: CANON KABUSHIKI KAISHA, Tokyo (JP)

(72) Inventor: Yukiteru Yano, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 175 days.

(21) Appl. No.: 13/912,012

(22) Filed: Jun. 6, 2013

(65) Prior Publication Data

US 2013/0330494 A1 Dec. 12, 2013

(30) Foreign Application Priority Data

Jun. 12, 2012 (JP) ..... 2012-132762

(51) Int. Cl.
*G09F 3/10* (2006.01)
*G09F 3/02* (2006.01)

(52) U.S. Cl.
CPC ..... *G09F 3/10* (2013.01); *G09F 2003/0267* (2013.01); *Y10T 428/14* (2015.01); *Y10T 428/149* (2015.01); *Y10T 428/1476* (2015.01)

(58) Field of Classification Search
CPC . G09F 3/10; G09F 2003/0267; Y10T 428/14; Y10T 428/1476; Y10T 428/1486; Y10T 428/149; Y10T 428/1495; Y10T 428/15
See application file for complete search history.

(56) References Cited

U.S. PATENT DOCUMENTS

| | | | | |
|---|---|---|---|---|
| 3,661,625 | A * | 5/1972 | La Mers | 428/43 |
| 3,920,122 | A * | 11/1975 | Koehlinger et al. | 206/390 |
| 4,166,144 | A * | 8/1979 | Amberkar | 428/40.9 |
| 4,217,164 | A * | 8/1980 | La Mers | 156/541 |
| 4,309,468 | A * | 1/1982 | St. Aubin | 428/42.3 |
| 4,951,971 | A * | 8/1990 | Whited | 283/80 |
| 5,017,412 | A * | 5/1991 | Bekker-Madsen | 428/43 |
| 5,702,789 | A * | 12/1997 | Fernandez-Kirchberger et al. | 428/40.1 |
| 6,803,084 | B1 * | 10/2004 | Do et al. | 428/40.1 |
| 2004/0065407 | A1 * | 4/2004 | Arway et al. | 156/277 |
| 2006/0147668 | A1 * | 7/2006 | Hirose et al. | 428/42.3 |
| 2006/0257608 | A1 * | 11/2006 | Severn et al. | 428/40.1 |

FOREIGN PATENT DOCUMENTS

JP 10-181228 A 7/1998

* cited by examiner

*Primary Examiner* — Patricia L Nordmeyer
(74) *Attorney, Agent, or Firm* — Canon USA, Inc IP Division

(57) ABSTRACT

A sticker recording sheet includes an image-receiving paper portion having an receiving layer, an image-receiving base material, and an adhesive layer laminated on each other, and a release coated paper portion provided on a back surface side of the adhesive layer in a peelable manner, wherein the image-receiving paper portion is provided with a first half-cut portion cut in an approximately square shape, having an uncut bridge portion on at least one side of the approximately square shape, and a second half-cut portion cut from at least one side of the approximately square shape having the bridge portion toward an outer circumference of the image-receiving paper portion.

8 Claims, 12 Drawing Sheets

STICKER RECORDING SHEET

BACKGROUND OF THE INVENTION

1. Field of the Invention

The present invention relates to a sticker recording sheet printed by a printing apparatus.

2. Description of the Related Art

A thermal transfer printing apparatus is a suitable printing apparatus for printing and outputting the information of an electronic image captured by a digital still camera or a video camera directly or through a computer and a storage medium.

Further, as a recording sheet, a sticker type recording sheet (sticker recording sheet) has been widely used. For example, a product employing a sticker type recording sheet has been produced, so that a user can print and output a desired image to enjoy a photograph as a sticker by using the sticker type recording sheet.

There are two types of stick recording sheets. One sticker recording sheet is a type in which the entire recording sheet is peeled from a release coated paper and used. Another type sticker recording sheet is a type in which a sheet is cut or halfway cut into a frame shape smaller than the outer shape of the recording sheet to the adhesive layer or the upper portion of the release coated paper thereof, so that only a framed portion is peeled and used.

When a sticker recording sheet on which half-cut processing is performed in a frame-shaped state is conveyed in a printing apparatus, the half-cut portion may be turned up to wind around a roller, or adhere to a conveyance guide or an ink ribbon, and may cause a paper jam.

To solve this problem, Japanese Patent Application Laid-Open No. 10-181228 discloses a technique for preventing a running failure from occurring. In the technique, a bridge portion on which the half-cut processing is not performed is provided on a part of the half-cut portion, so that the bridge portion connects a sticker portion inside the frame shape to the frame portion outside the frame shape.

SUMMARY OF THE INVENTION

According to an aspect of the present invention, a sticker recording sheet includes an image-receiving paper portion having an receiving layer, an image-receiving base material, and an adhesive layer laminated on each other, and a release coated paper portion provided on a back surface side of the adhesive layer in a peelable manner, wherein the image-receiving paper portion is provided with a first half-cut portion cut in an approximately square shape, having an uncut bridge portion on at least one side of the approximately square shape, and a second half-cut portion cut from at least one side of the approximately square shape having the bridge portion toward an outer circumference of the image-receiving paper portion.

Further features of the present invention will become apparent from the following description of exemplary embodiments with reference to the attached drawings.

DESCRIPTION OF THE EMBODIMENTS

First, a sticker recording sheet will be described with reference to FIG. 10.

Figure 10:
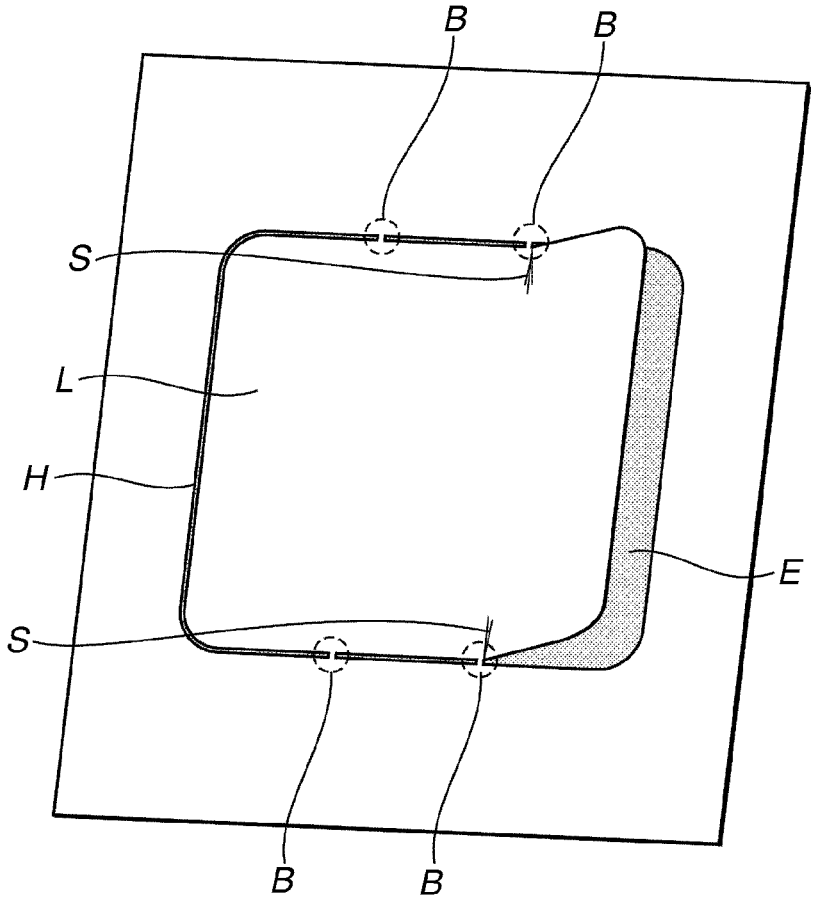
FIG. 10 is a diagram illustrating a sticker recording sheet.

FIG. 10 is a diagram illustrating a state where a sticker portion of the sticker recording sheet with bridge portions provided on a half-cut portion is being peeled.

An outer shape of a sticker portion L is formed by a half-cut portion H, and bridge portions B are provided on a part of the half-cut portion H.

Therefore, as illustrated in FIG. 10, if the bridge portions B are provided on a part of the half-cut portion H of the sticker recording sheet, when the sticker portion L within the frame is peeled from a release coated paper portion E, stress is concentrated on connected portions before the bridge portions B are cut and peeled. As a result, as illustrated in FIG. 10, there is a problem in that creases S are formed on a surface of the sticker portion L by making the bridge portions B as starting points, and the creases S are left on the sticker portion L due to plastic deformation.

In this manner, the creases S are easily formed at the bridge portions B when the sticker portion L is peeled in a direction parallel to a half-cut line, by making the bridge portions B as bending points, in a state where the bending degree of the sticker portion L is increased due to a small angle formed between a sticker surface that has not been peeled and a sticker portion that has been peeled.

When a sticker recording sheet is printed by a thermal transfer printing apparatus, in many cases, printing is executed by using the same conveyance system as that of a general photographic recording sheet of approximately 200 μm thickness. Therefore, if a portion configured of a receiving layer excluding release coated paper, a base material, and an adhesive layer is referred to as a receiving layer portion, this receiving layer portion is very thin, with a thickness of approximately dozens of micrometers to 100 micrometers. When the receiving layer portion is thin like this, the creases may be formed peculiarly easily, and thus it is difficult to prevent the creases from being formed even if the bridge portion is formed in a smaller size.

Therefore, a purpose of the sticker recording sheet according to the present invention is to provide a sticker recording sheet on which the creases are not formed easily when the sticker recording sheet is peeled from the release coated paper.

A first exemplary embodiment of the present invention will be described below in detail with reference to the drawings.

<Sticker Recording Sheet>

First, a configuration of a sticker recording sheet according to the present exemplary embodiment will be described with reference to FIGS. 1A and 1B.

Figure 1A:
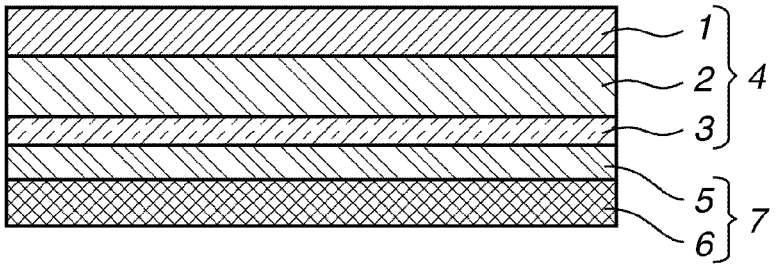
FIGS. 1A and 1B are diagrams illustrating a sticker recording sheet according to a first exemplary embodiment.
Figure 1B:
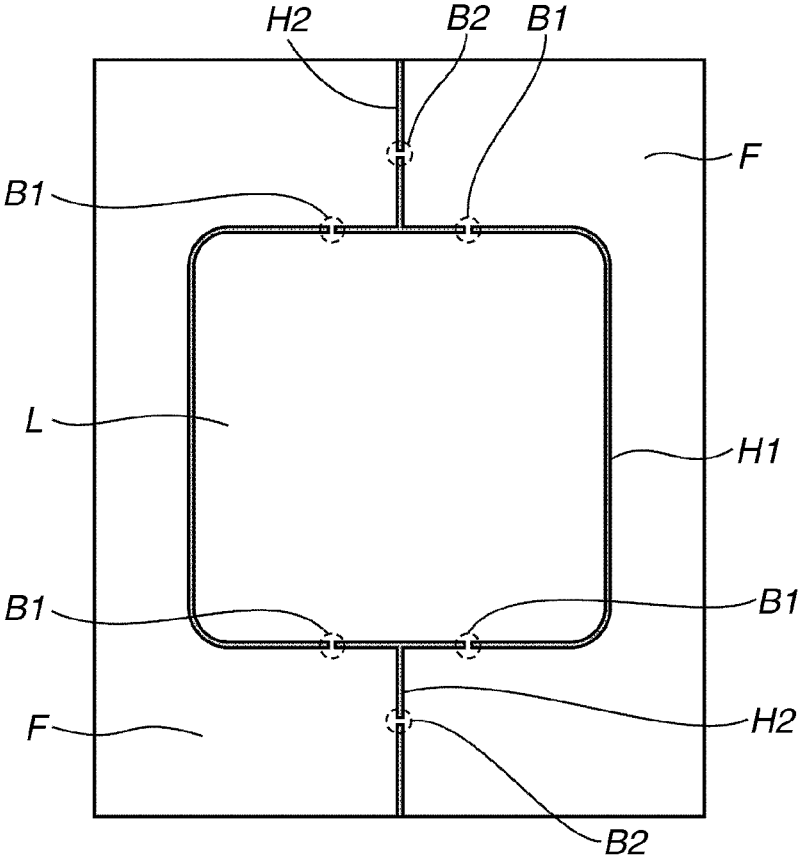

FIG. 1A is a cross-sectional view of the sticker recording sheet according to the present exemplary embodiment, and FIG. 1B is a top plan view of the sticker recording sheet according to the present exemplary embodiment.

In the sticker recording sheet according to the present exemplary embodiment, as illustrated in the cross-sectional view of FIG. 1A, an image-receiving paper portion 4 is formed on an upper layer portion including a receiving layer 1 as an uppermost surface for receiving a color material, an image-receiving base material 2 for supporting the receiving layer 1, and an adhesive layer 3 formed on the lower surface of the image-receiving base material 2. Because the adhesive layer 3 is formed on the lower surface of the image-receiving paper portion 4, the image-receiving paper portion 4 can be used as a sticker.

Further, a release coated paper portion 7 is formed of a release coated layer 5 which the adhesive layer 3 can be adhered to and peeled from, and a support base material 6. The release coated paper portion 7 is disposed on the back surface side of the adhesive layer 3.

The sticker recording sheet is configured of the release coated paper portion 7 and the image-receiving paper portion 4, and the release coated paper portion 7 and the image-receiving paper portion 4 are laminated to each other by adhering the adhesive layer 3 to the release coated layer 5 in a peelable manner.

As illustrated in the top plan view of FIG. 1B, an approximately square-shaped half-cut portion H1 is formed on the image-receiving paper portion 4 by cutting the image-receiving portion 4 up to the lower surface of the adhesive layer 3, so as to separate the approximately square-shaped sticker portion L in a frame shape and a frame portion F serving as an outer frame thereof. The sticker portion L is formed inside the image-receiving paper portion 4.

A user peels the sticker portion L that is surrounded by the half-cut portion H1 from the release coated paper portion 7 and uses the sticker portion L by adhering to various kinds of items.

In the present exemplary embodiment, the half-cut portion H1 is formed by cutting the image-receiving paper portion 4 up to the lower surface of the adhesive layer 3. However, as long as the image-receiving paper portion 4 is cut up to the adhesive layer 3, cutting can be extended to a part of the release coated layer 5, and thus the cutting is regarded as "half-cut" unless the cutting is completely extended up to the lower surface of the release coated paper portion 7. The cutting depth thereof can be appropriately set as necessary.

A bridge portion B1 as an uncut portion is provided on a part of the half-cut portion H1. With this, the sticker portion L and the frame portion F separated by the half-cut portion H1 are connected to each other to prevent them from being peeled off while printing is executed, and thus a running failure is prevented from occurring.

Further, on one side of the half-cut portion H1 having the bridge portion B1, a second half-cut portion H2 is provided at a position on the half-cut portion H1 other than the position of the bridge portions B1, so as to connect to an edge portion as the outer circumference of the image-receiving paper portion 4. In the same manner as the half-cut portion H1, the second half-cut portion H2 is also formed by cutting the image-receiving paper portion 4 up to the adhesive layer 3. An edge portion of the half-cut portion H2 on the side of the sticker portion L is connected with the first half-cut portion H1.

A bridge portion B2 as an uncut portion is also provided on the half-cut portion H2. With this configuration, the frame portions F separated by the half-cut portion H2 are connected to each other and prevented from being peeled off when printing is executed, and thus a running failure is prevented from occurring.

The sticker recording sheet according to the present exemplary embodiment is provided with the half-cut portion H2. Because a portion for connecting the edge surface and the half-cut portion H2 is easily peeled, the frame portion F can be peeled easily.

If the second half-cut portion H2 is not provided, the sticker portion L is peeled from the half-cut portion H1, and therefore, the creases are formed thereon as illustrated in FIG. 10. Further, if the frame portion F is peeled in advance, the frame portion F is difficult to be peeled because the user has to peel the frame portion F from the edge surface thereof by placing a nail between the adhesive layer 3 and the release coated layer 5 of an outer circumference cross-sectional surface. Furthermore, when the user peels the frame portion F, there may be a case where a corner portion of the edge surface of the sticker recording sheet enters the inner side of the nail accidentally.

By providing the half-cut portion H2, a starting point for peeling the image-receiving paper portion 4 can be formed easily, and the frame portion F is easy to be peeled.

Next, referring to FIG. 2, the effect of providing the half-cut portion H2 to peel the frame portion F in advance will be described.

The user holds the frame portion F of which the edge surface is lifted up and starts peeling the frame portion F along the half-cut portion H2. When the user further peels the frame portion F to cut the bridge portion B2, the half-cut portion H2 is connected to the half-cut portion H1, so that the frame portion F is peeled along the half-cut portion H1.

Figure 2:
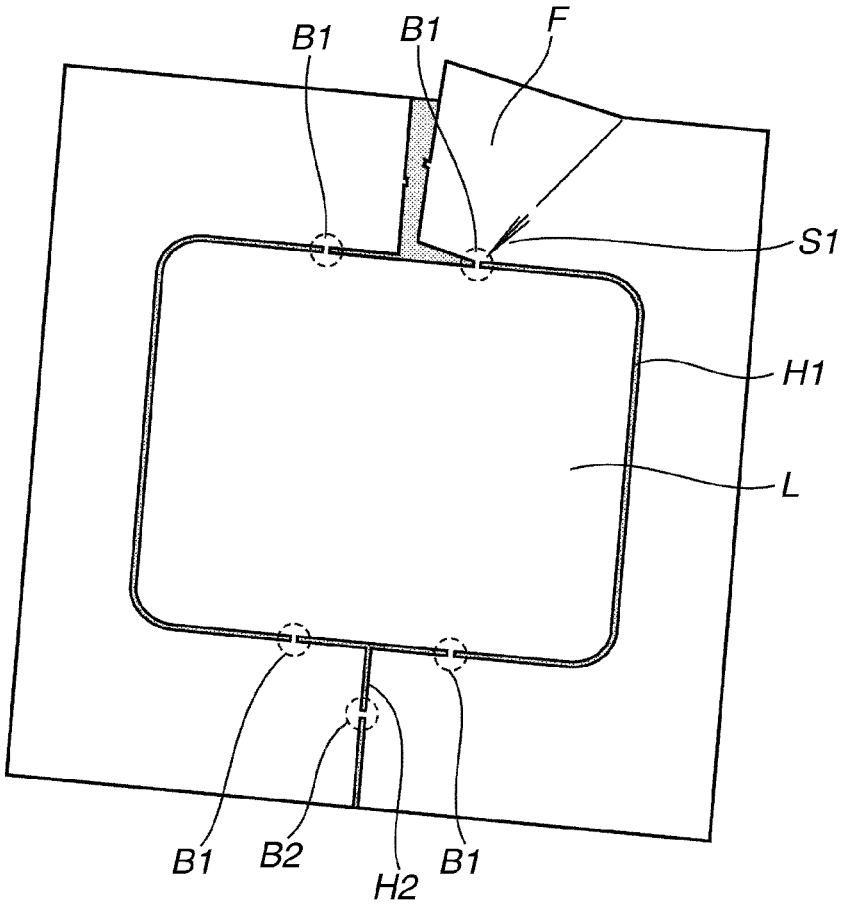
FIG. 2 is a diagram illustrating the sticker recording sheet according to the first exemplary embodiment.

FIG. 2 is a diagram of the sticker recording sheet according to the present exemplary embodiment illustrating a state where the frame portion F is being peeled, and a peeled portion of the frame F reaches a position connected by the bridge portion B1 provided on the half-cut portion H1.

The peeled frame portion F is temporarily bent immediately before the bridge portion B1 is cut. Since the stress is concentrated particularly in a vicinity of the bridge portion B1, a crease S1 may be formed thereon due to plastic deformation.

On the other hand, when the bridge portion B1 is cut, the sticker portion L in the vicinity of the bridge portion B1 is held in a posture in which the adhesive layer 3 and the release coated layer 5 are adhered to each other, and thus the crease is hardly formed thereon. Therefore, the crease is left on the frame portion F where the quality thereof is not so important, while the crease is not formed on the sticker portion L that is to be used practically, and thus the high-quality sticker can be provided.

Further, from the side of the half-cut portion H1 having the bridge portion B1, the half-cut portion H2 is provided in an approximately perpendicular direction. Therefore, when the frame portion F is peeled from the half-cut portion H2, the frame portion F is peeled in a direction approximately parallel to the side having the bridge portion B1. Accordingly, the stress exerted on the bridge portion B1 is applied in a peeling direction, so that the sticker portion L will not be damaged, and a portion in the vicinity of the bridge portion B1 will not be cut into the side of the sticker portion L. Therefore, the sticker portion L is prevented from being chipped.

A suitable layout for providing the half-cut portion H2 and the bridge portion B1 will be described.

In order to peel the frame portion F smoothly from the half-cut portion H2 along the half-cut portion H1, the bridge portion B1 is desirably provided on a position that is properly distant from the position where the half-cut portion H2 is connected to the half-cut portion H1.

If the bridge portion B1 is positioned too close to the joining portion of the half-cut portion H2 and the half-cut portion H1, peeling force acting thereon along the half-cut portion H2 may be applied to the sticker portion L via the bridge portion B1. In such a case, the sticker portion L may be peeled off or the sticker portion L may be torn, so that the peeling performance is lowered.

Accordingly, it is desirable that the bridge portion B1 on the half-cut portion H1 is provided on a position that is slightly distant from the joining position of the half-cut portion H2, and thus the bridge portion B1 is desirably provided on an approximately center position between the position of the half-cut portion H2 and the approximately square-shaped corner position.

Further, as illustrated in FIG. 1B, in a case where two bridge portions B1 are formed on one side, by forming the half-cut portion H2 on the approximately center of the two bridge portions B1, the frame portion F can be peeled off without causing the sticker portion L in the vicinity of the bridge portions B1 to be damaged.

<Configuration of Thermal Transfer Printing Apparatus and Printing Operation>

Figure 3:
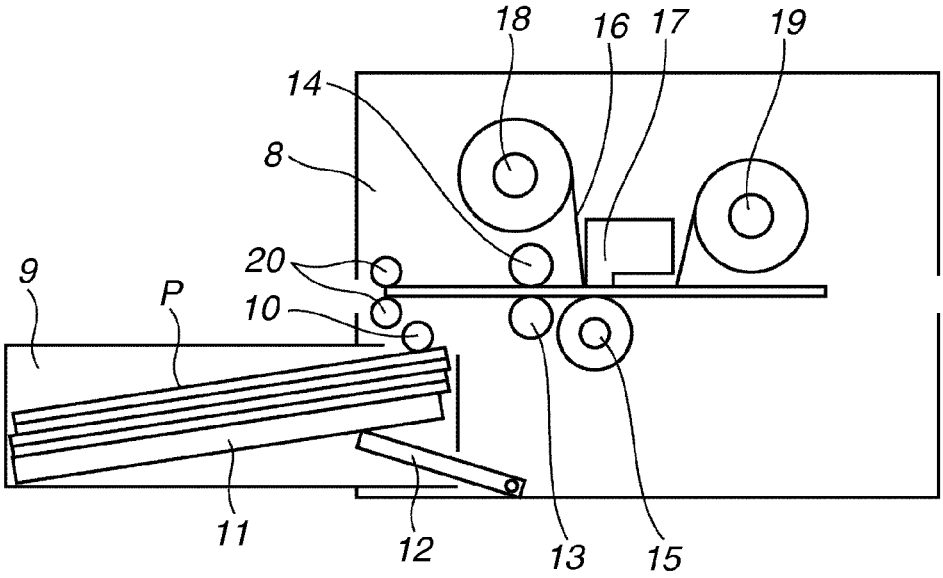
FIG. 3 is a cross-sectional view schematically illustrating a printing apparatus for using the sticker recording sheet according to the first exemplary embodiment.

FIG. 3 is a diagram illustrating a configuration of a thermal transfer printing apparatus configured to perform printing by using the sticker recording sheet according to the present exemplary embodiment.

A plurality of sticker recording sheets P is stacked on a paper cassette 9. The paper cassette 9 is detachable from a thermal transfer printing apparatus 8. A feeding roller 10 is disposed on the upper side of the paper cassette 9 to separate the sticker recording sheets P stacked on the paper cassette 9 and feed the separated sheets P one-by-one.

A lifting plate 11 is disposed at the bottom portion of the sticker recording sheets P. When a feeding operation is performed by the feeding roller 10, the lifting plate 11 is lifted up by a lifting lever 12 that is inserted into the paper cassette 9 from the thermal transfer printing apparatus 8. When the lifting plate 11 is lifted up, the uppermost sheet of the sticker recording sheets P is pressed by the feeding roller 10, so as to be conveyed by the rotation of the feeding roller 10. Then, the sticker recording sheet P fed by the feeding roller 10 is held by the conveyance roller 13 and a pinch roller 14, and the conveyance roller 13 moves the sticker recording sheet P back and forth when printing is executed.

Projected portions in which minute projections are arranged on a roller surface in the vicinities of both end portions are disposed on a part of the conveyance roller 13. The projections of the projected portions stick into the back surface of the sticker recording sheet P to firmly hold and convey the sticker recording sheet P.

In the vicinity of the conveyance roller 13, a thermal head 17 for executing printing by pressing the ink sheet 16 against the sticker recording sheet P while selectively applying heat is disposed. A platen roller 15 is disposed on a position opposing the thermal head 17 with a conveyance path therebetween. The thermal head 17 is driven while the ink sheet 16 and the sticker recording sheet P are pressurized and brought into contact by the thermal head 17 and the platen roller 15. Through this operation, ink of the ink sheet 16 is transferred to the sticker recording sheet P, and an image or text is printed thereon. On the thermal head 17, a plurality of heating elements are arranged and disposed in a row, and the heating elements are selectively driven based on print data to acquire a desired print output.

An unused portion of the ink sheet 16 is wound on a supply bobbin 19. When a wind up bobbin 18 is rotationally driven, the ink sheet 16 on the supply bobbin 19 is drawn out and taken up by the wind up bobbin 18. On the way to the wind up roller 18, the ink sheet 16 passes between the thermal head 17 and the platen roller 15 so that the ink of the ink sheet 16 is transferred to the sticker recording sheet P at this position.

The ink sheet 16 includes ink layers of thermal sublimation ink in respective colors of yellow, magenta, cyan, and an overcoat layer of hot-melt ink for protecting a printed surface of the sticker recording sheet P.

Each ink layer and the overcoat layer have widths approximately equivalent to a width of a printing area of the sticker recording sheet P, and are arranged in a frame sequential manner in the conveyance direction of the ink sheet 16.

A paper discharge roller pair 20 for discharging the sticker recording sheet P to a discharge paper tray located outside the thermal transfer printing apparatus 8 is disposed at a paper discharge position of the sticker recording sheet P.

Next, an image printing operation performed by the thermal transfer printing apparatus 8 will be described.

The feeding roller 10 separates and conveys each of the sticker recording sheets P stacked on the paper cassette 9 one-by-one to the position where the sticker recording sheet P is nipped by the conveyance roller 13 and the pinch roller 14. Thereafter, the sticker recording sheet P is conveyed to the print start position by the conveyance roller 13 and the pinch roller 14. The ink sheet 16 is conveyed and driven by the rotation of the wind up bobbin 18, so that the ink layer of the first color is arranged on a printing position where the heating elements of the thermal head 17 are located.

While the sticker recording sheet P is conveyed by the conveyance roller 13 and the pinch roller 14, the thermal head 17 is driven to transfer the ink of the ink sheet 16 to the sticker recording sheet P, so that printing of the first color is executed. Three colors of inks, yellow, magenta, cyan, and the overcoat are applied on the ink sheet 16 according to the present exemplary embodiment. Therefore, when image formation of the first color is completed, the conveyance roller 13 is driven and conveys the sticker recording sheet P backward to the print start position, while the ink sheet 16 is driven and conveyed so as to cause ink of the second color to be arranged at the printing position. Thereafter, printing of the second color is executed. In this manner, an image is formed by transferring all the colors of ink to the sticker recording sheet P. Further, the overcoat for protecting the image is transferred onto the image.

After printing, the sticker recording sheet P is discharged to the paper discharge tray disposed outside the thermal transfer printing apparatus 8 by the discharge roller pair 20, so that the printing operation is completed.

As described above, because an image is formed by transferring to superpose a plurality of colors of ink in a sequential manner, the sticker recording sheet P is conveyed within the thermal transfer printing apparatus 8 back and forth for a plurality of times. In addition, the printing position of each color needs to be matched precisely. Therefore, in order to prevent the positional deviation of the sticker recording sheet P held between the conveyance roller 13 and the pinch roller 14, the pinch roller 14 is pressed against the conveyance roller 13, and projections are disposed on a part of the areas of the conveyance roller 13.

These projections catch and firmly bite into the back surface of the sticker recording sheet P, so that the sticker recording sheet P is conveyed without being deviated. The projected portion is not provided on the entire surface of the conveyance roller 13 but only on a part of the area. The projected portion is provided only a part of the area instead of the entire surface thereof because the projections may cause the back side of the sticker recording sheet P to be damaged.

<Relationship of Sticker Recording Sheet and Conveyance Roller>

Figure 4:
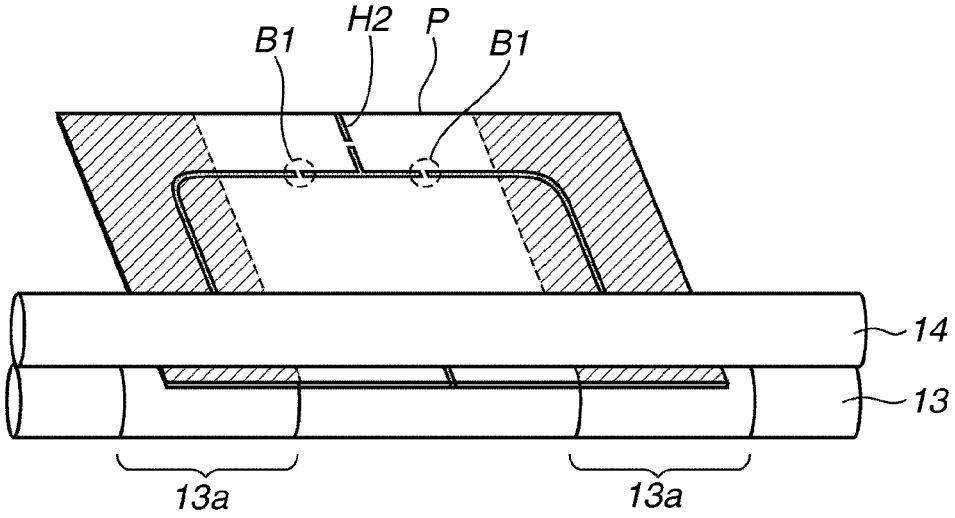
FIG. 4 is a perspective view of a portion where a sticker recording sheet is held between a conveyance roller and a pinch roller of a printing apparatus for using the sticker recording sheet according to the first exemplary embodiment.

FIG. 4 is a perspective view of the portion where the sticker recording sheet P is held between the conveyance roller 13 and the pinch roller 14.

The projections for gripping the sticker recording sheet P are provided on the portions of the conveyance roller 13 in projection areas 13*a*. The shaded areas in the vicinities of both ends of the sticker recording sheet P indicate the areas where the projected portions of the conveyance roller 13 stick into the back surface. Because these areas are abutting areas where the portions in the conveyance roller 13 projected more than the other portions make contact with, the sticker recording sheet P receives greater force and damage.

Accordingly, because the shaded areas which are stuck by the projections provided on the projection areas 13*a* are pressed harder than the other portions, it is better not to provide the bridge portion B1 or the bridge portion B2. If the bridge portions are provided on the shaded areas, the shaded areas are damaged and cut due to strong pressure.

Similarly, the half-cut portion H2 is desirably provided on the area other than the shaded areas because at the moment when the half-cut portion H2 is strongly held, or rushed into the rollers that are strongly pressurized, a cutting surface thereof may be turned up.

Further, if the half-cut portion H2 is provided perpendicularly or obliquely with respect to the conveyance direction of the sticker recording sheet P, the edge surface thereof is easily caught and peeled off when the half-cut portion H2 is held by the conveyance roller, and thus the half-cut portion H2 is desirably provided approximately parallel to the conveyance direction.

Furthermore, if the half-cut portion H2 is provided in the direction perpendicular to the conveyance direction, i.e., the axis direction of the conveyance roller 13, due to a shock caused by a step portion at a cutting line passing through a nip portion of the conveyance roller 13, the conveyance speed of the sticker recording sheet P becomes irregular, so as to cause density unevenness. Therefore, the half-cut portion H2 is desirably provided in a direction parallel to the conveyance direction as much as possible.

Because of the reasons described above, the bridge portion B1 of the half-cut portion H1 is desirably provided on an approximately center position between a joining position of the half-cut portion H2 and the half-cut portion H1, and the corner portion of the approximately square shape formed by the half-cut portion H1.

In a case where the sticker recording sheet P is used in an apparatus configured to convey the sticker recording sheet P by holding the vicinities of both end portions thereof by a projected roller and a pinch roller that is disposed opposing thereto, it is preferable that the second half-cut portion H2 is provided in a vicinity of the approximately center in the sheet width direction, and parallel to the conveyance direction.

Further, in the sticker recording sheet P according to the present exemplary embodiment, the bridge portion B1 is provided on the side of the half-cut portion H1 parallel to the conveyance roller 13 at the time of printing, extending in a direction orthogonal to the conveyance direction. Two sides of the half-cut portion H1 parallel to the axis of the conveyance roller 13 can be peeled off easily because the entire portions thereof are pressurized by the conveyance roller 13 and the pinch roller 14. Therefore, the two sides are prevented from being peeled off by providing the bridge portions. On the other hand, other two sides extending in a direction parallel to the conveyance direction (a direction orthogonal to the shaft of the conveyance roller 13) cannot be peeled off easily because only a part of the other two sides are pressurized by the conveyance roller 13 and the pinch roller 14. Therefore, the bridge portions are not provided thereon.

<Configuration of Bridge Portion B2>

Figure 5:
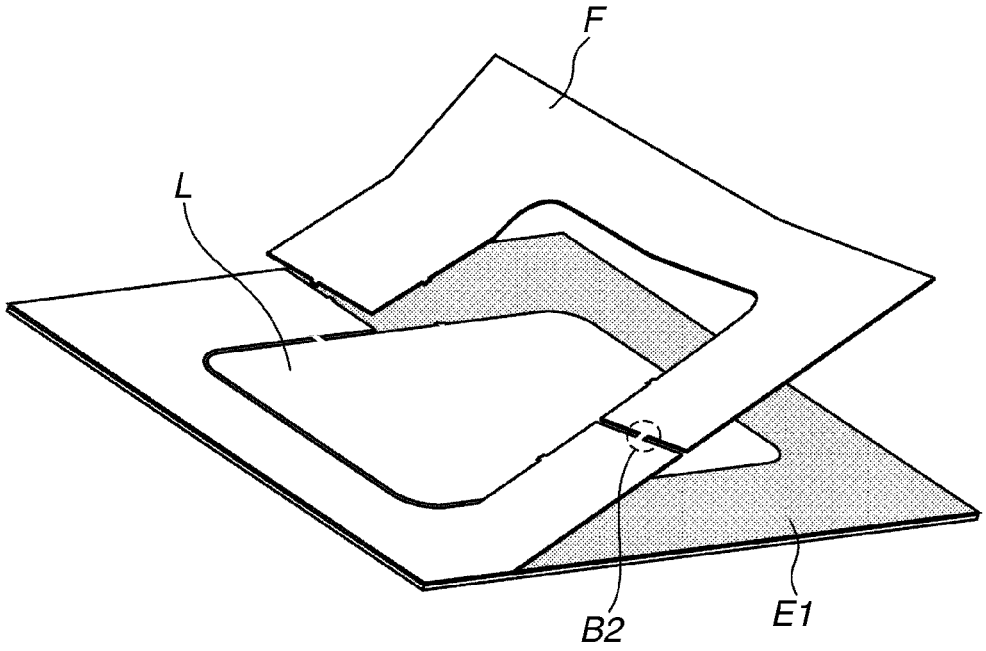
FIG. 5 is a diagram illustrating the sticker recording sheet according to the first exemplary embodiment.

FIG. 5 is a diagram illustrating a state where one of the bridge portions B2 provided on one of the half-cut portions H2 has been left uncut when the frame portion F of the sticker recording sheet according to the present exemplary embodiment is being peeled.

In the sticker recording sheet according to the present exemplary embodiment, the half-cut portions H2 are provided respectively on two sides of the approximately square-shaped half-cut portion H1 opposing each other. In other words, the half-cut portions H2 are provided by cutting from each of the two sides of the half-cut portion H1 opposing each other, toward the outer circumference, up to the edge portion of the sticker recording sheet. Making the half-cut portions H2 be configured in a symmetrical manner is convenient in that the half-cut portion H2 can be peeled from the either side. In addition, because of the symmetrical shape thereof, a loading direction does not have to be taken into consideration when the sticker recording sheet is loaded on the paper cassette 9.

Further, as described in the present exemplary embodiment, because the bridges B2 are provided on the half-cut portions H2, in a case where one of the bridge portions B2 is cut and the frame portion F is peeled from that half-cut portion H2, as illustrated in FIG. 5, the other bridge portion B2 may be left without being cut. In this case, the frame portion F can also be removed entirely by a single peeling operation.

Therefore, in order to allow a user to peel the frame portion F easily by the single peeling operation, the bridge portion B2 may be configured as those described below in a second exemplary embodiment and a third exemplary embodiment.

Figure 6:
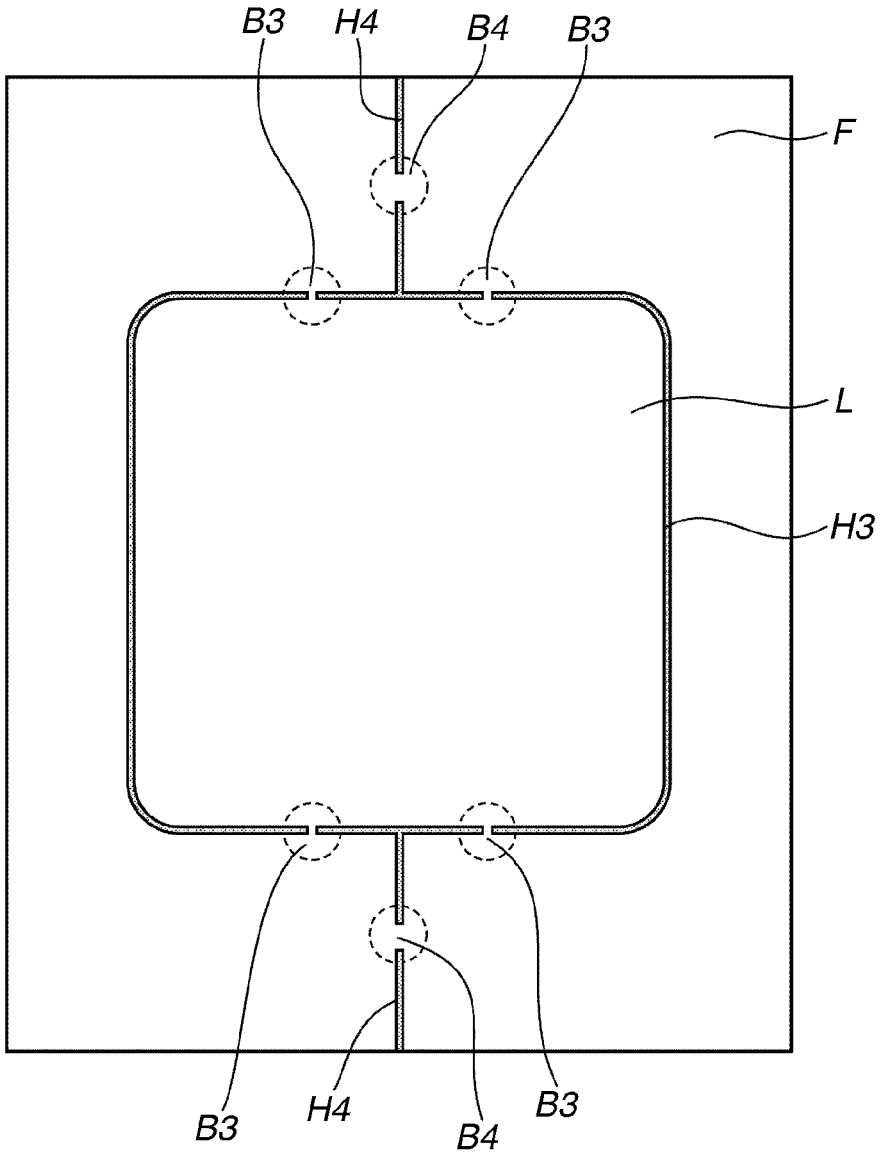
FIG. 6 is a diagram illustrating a sticker recording sheet according to a second exemplary embodiment.

FIG. 6 is a diagram illustrating a sticker recording sheet according to a second exemplary embodiment.

A cross-sectional structure is the same as that of the sticker recording sheet according to the first exemplary embodiment.

In the sticker recording sheet according to the present exemplary embodiment, similar to that of the first exemplary embodiment, a half-cut portion H3 is formed on the image-receiving paper portion 4, so as to separate the approximately square-shaped sticker portion L and the frame portion F that is an outer frame.

A bridge portion B3, which is an uncut portion, is provided on the half-cut portion H3. With the bridge portion B3, the sticker portion L and the frame portion F separated by the half-cut portion H3 are connected to each other and prevented from being peeled off while printing is executed, and thus a running failure is prevented from occurring.

Similar to the first exemplary embodiment, the conveyance direction at the time of printing the sticker recording sheet according to the present exemplary embodiment is a direction perpendicular to a side of the half-cut portion H3 for forming the sticker portion L, having the bridge portion B3.

Further, on one side provided with the bridge portion B3, a second half-cut portion H4 is formed on a position other than the position of the bridge portion B3, so as to connect to the outer circumference of the image-receiving paper portion 4.

A bridge portion B4, which is an uncut portion, is also provided on the half-cut portion H4. With the bridge portion B4, the frame portions F separated by the half-cut portion H3 are connected to each other and prevented from being peeled off while printing is executed, and thus a running failure is prevented from occurring.

The present exemplary embodiment is different from the first exemplary embodiment in that the width of the bridge portion B4 provided on the second half-cut portion H4 is wider than that of the bridge B3 provided on the half-cut portion H3.

With this configuration, at a peeling operation, when one side of the half-cut portion H4 is peeled along the first half-cut portion H3, the bridge portion B4 of the half-cut portion H4 provided perpendicularly with respect to the peeling direction is left uncut easily due to the wider width.

With the above configuration, the frame portions F can be peeled as a connected piece of frame at one time.

In order to reduce the uncut residual amount of the bridge portion B3 on the sticker portion L, the bridge portion B3 for joining the sticker portion L with the frame portion F should be configured to have a minimum width that can join and hold the sticker portion L and the frame portion F during the conveyance period.

However, as for the bridge portion B4 for connecting the frame portions F, the uncut residual amount of the bridge portion does not have to be taken into consideration.

Providing the half-cut portions H4 in two directions realizes the improvement in convenience of the peeling operation, and by increasing the width of the bridge portion B4, the frame portions F can be peeled as a connected piece of frame at one time without cutting the bridge portion B4 at the half-cut portion H4 halfway in the peeling operation.

Further, the configuration in which the frame portion F can be peeled easily in advance is the same as that of the first exemplary embodiment, and thus the purpose for not forming the creases on the sticker portion L can be achieved.

Next, a third exemplary embodiment for realizing approximately the same effect as that of the second exemplary embodiment by other configuration will be described.

Figure 7:
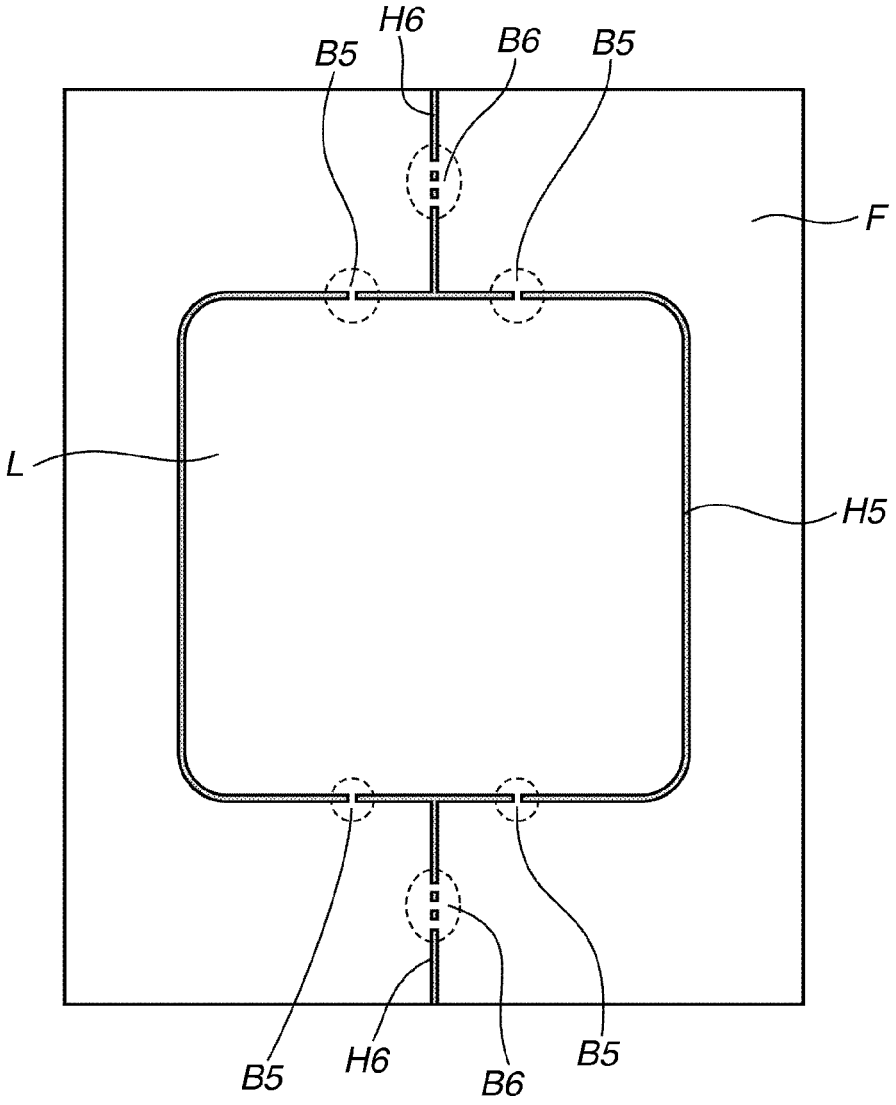
FIG. 7 is a diagram illustrating a sticker recording sheet according to a third exemplary embodiment.

FIG. 7 is a top plan view of a sticker recording sheet according to the present exemplary embodiment.

Similar to the second exemplary embodiment, a cross-sectional configuration is the same as that of the sticker recording sheet according to the first exemplary embodiment.

In the sticker recording sheet according to the present exemplary embodiment, similar to the above described exemplary embodiments, a half-cut portion H5 is formed on the image-receiving paper portion 4, so as to separate the approximately square-shaped sticker portion L and the frame portion F as the outer frame.

A bridge B5, which is an uncut portion, is provided on the half-cut portion H5.

Similar to the first exemplary embodiment, the conveyance direction at the time of printing the sticker recording sheet according to the present exemplary embodiment is a direction perpendicular to a side of the half-cut portion H5 for forming the sticker portion L, having the bridge portion B5.

Further, on one side having the bridge portion B5, a second half-cut portion H6 is formed on a position other than the position of the bridge portion B5, so as to connect to the outer circumference of the image-receiving paper portion 4.

A bridge portion B6, which is an uncut portion, is also provided on the half-cut portion H6. However, the present exemplary embodiment is different from the second exemplary embodiment in that a plurality of bridge portions B6 is provided on one side of the half-cut portion H6 in a consecutive manner.

With this configuration, at a peeling operation, when one side of the one half-cut portion H6 is peeled along the first half-cut portion H5, the bridge portions B6 of the other half-cut portion H6 provided perpendicularly with respect to the peeling direction are left uncut easily because a plurality of the bridge portions B6 has stronger holding force.

With the above configuration, the frame portions F can be peeled as a connected piece at one time.

In the same manner as the second exemplary embodiment, the present exemplary embodiment can realize the improvement in convenience of the peeling operation by providing the half-cut portions H6 in two directions. In addition, by increasing the number of bridge portions B6, the peeled frame portions F can be peeled as a connected piece of frame at one time without being cut at the half-cut portion H6.

Further, the configuration in which the frame portion F can be peeled easily in advance is similar to that of the first exemplary embodiment, and thus the purpose for not forming the creases on the sticker portion L can be achieved.

A fourth exemplary embodiment will be described with reference to FIGS. 8A and 8B.

Figure 8B:
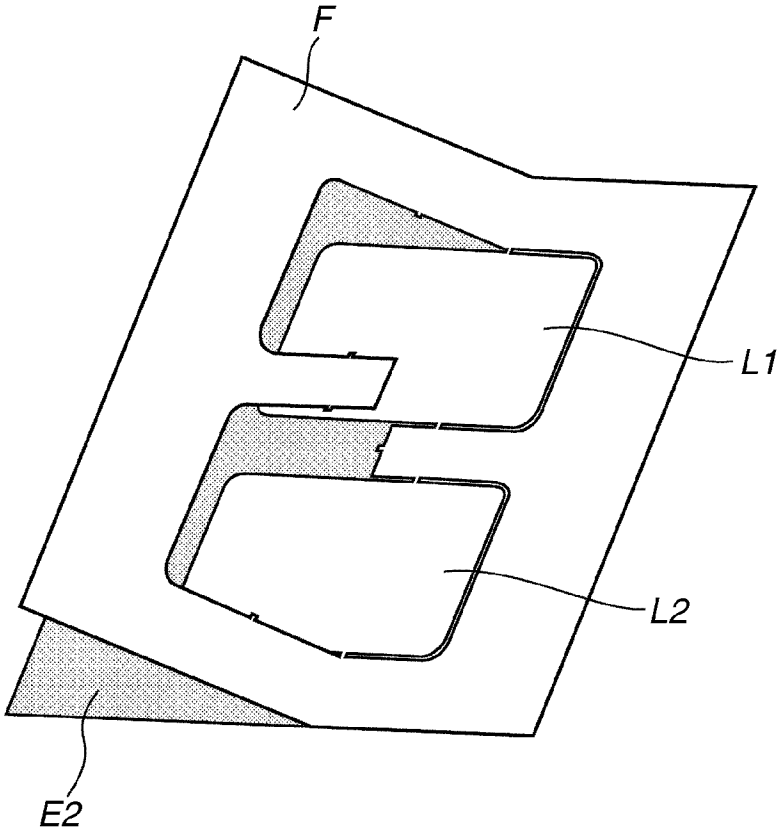
FIGS. 8A and 8B are diagrams illustrating a sticker recording sheet according to a fourth exemplary embodiment.
Figure 8A:
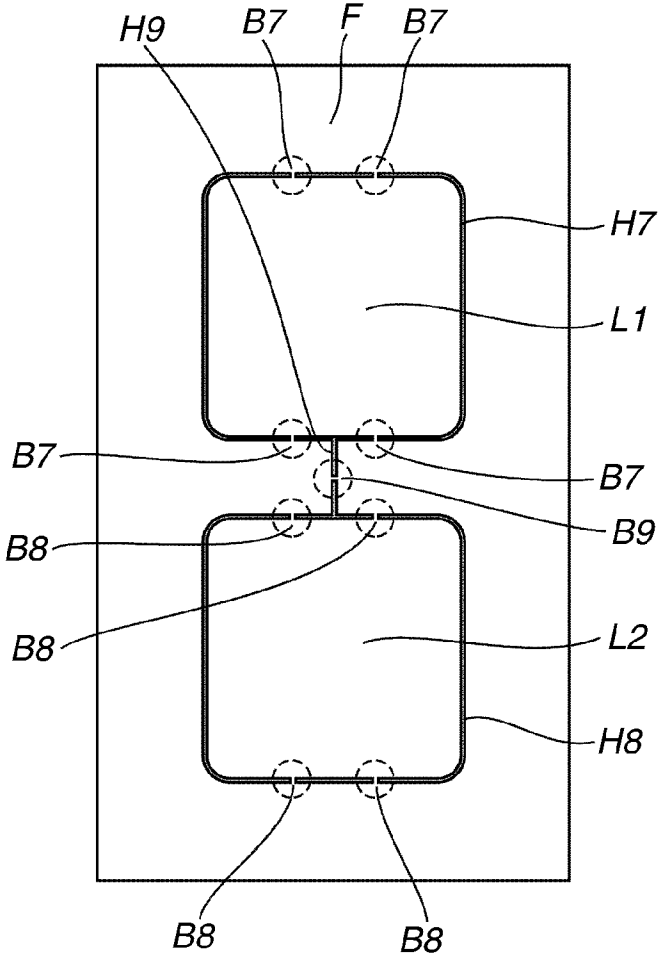

FIG. 8A is a top plan view of a sticker recording sheet according to the present exemplary embodiment.

The layer configuration of the sticker recording sheet according to the present exemplary embodiment is the same as that of the first exemplary embodiment except that two pieces of sticker portions L1 and L2 are configured within one sticker recording sheet while the circumferences of respective sticker portions L1 and L2 are surrounded by half-cut portions H7 and H8.

Further, similar to the first exemplary embodiment, in order to prevent the sticker portions L1 and L2 from being peeled during the running period, four pieces each of bridge portions B7 and B8 are disposed on the half-cut portions H7 and H8 respectively.

Similar to the first exemplary embodiment, the conveyance direction at the time of printing the sticker recording sheet according to the present exemplary embodiment is a direction perpendicular to the sides of the half-cut portions H7 and H8 for forming the sticker portions L1 and L2, having the bridge portions B7 and B8.

One aspect of the present exemplary embodiment is to provide a half-cut portion H9 for joining the half-cut portions H7 and H8.

FIG. 8B is a diagram illustrating a state in which the frame portion F of the sticker recording sheet according to the present exemplary embodiment is being peeled in advance.

If the peeling operation is started by making the half-cut portion H9 as a starting point, the frame portion F as a circumference portion can be peeled in advance, and the creases formed in the vicinity of the bridge portions during the peeling operation are formed on the frame portion F. Therefore, the creases will not be formed when the sticker portions L1 and L2 are peeled from a release coated paper surface E2.

Accordingly, as described in the present exemplary embodiment, in the sticker recording sheet including two pieces of sticker portions formed by approximately square-shaped half-cut portions, forming the half-cut portions for connecting the sticker portions to each other can realize the sticker recording sheet on which the creases are not formed when the sticker portions are peeled.

Further, on the half-cut portion H9 according to the present exemplary embodiment, in order to enhance running safety during a printing-conveying period, a bridge portion B9 is provided. However, the bridge portion B9 does not necessarily have to be provided.

When a bridge portion is provided, as in the present exemplary embodiment, it is preferable that the bridge portion is provided on the approximately center of the half-cut portion because when the frame portion is peeled, the bride portion is separated from a corner portion as a peeling starting point, so that the peeling performance is increased.

Next, a fifth exemplary embodiment will be described with reference to FIGS. 9A, 9B, and 9C.

Figure 9A:
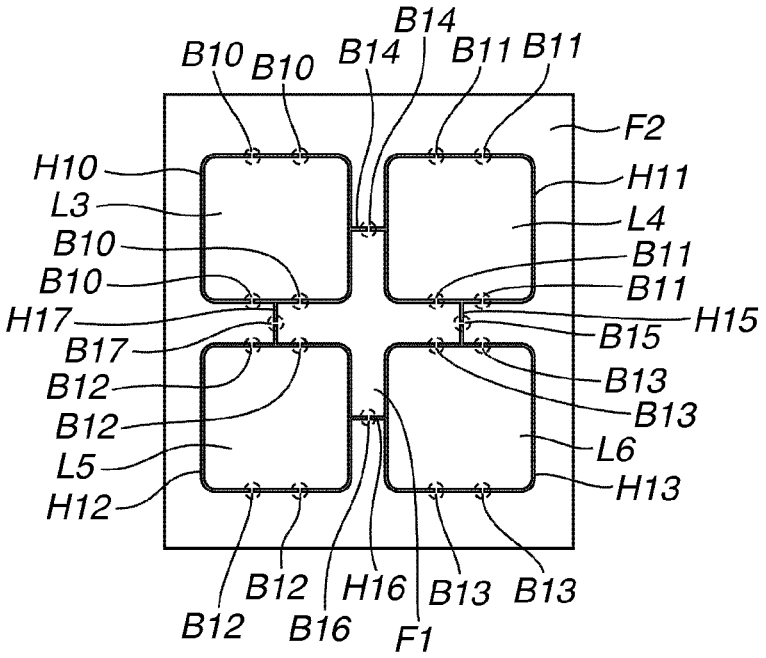
FIGS. 9A through 9C are diagrams illustrating a sticker recording sheet according to a fifth exemplary embodiment

FIG. 9A is a top plan view of a sticker recording sheet according to the present exemplary embodiment.

The layer configuration of the sticker recording sheet according to the present exemplary embodiment is the same as that of the first exemplary embodiment except that four pieces of sticker portions L3, L4, L5, and L6 are configured within a single sticker recording sheet. Further, the sticker portions L3, L4, L5, and L6 are formed by making respective circumferences thereof be surrounded by half-cut portions H10, H11, H12, and H13.

Further, similar to the above described exemplary embodiments, in order to prevent the sticker portions L3, L4, L5, and L6 from being peeled during the running period, four pieces each of bridge portions B10, B11, B12, and B13 are provided on the half-cut portions H10, H11, H12, and H13, respectively.

Similar to the first exemplary embodiment, the conveyance direction at the time of printing the sticker recording sheet according to the present exemplary embodiment is a direction perpendicular to respective sides of the half-cut portions H10, H11, H12, and H13 for forming the sticker portions L3, L4, L5, and L6, having the bridge portions B10, B11, B12, and B13.

Similar to the fourth exemplary embodiment, one aspect of the present exemplary embodiment is to dispose half-cut portions H14, H15, H16, and H17 for connecting the sticker portions L3, L4, L5, and L6 adjacent to each other.

Figure 9B:
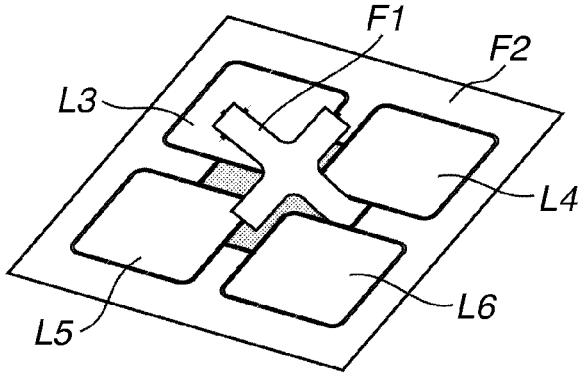

FIG. 9B is a diagram illustrating a state where an inner frame portion F1 surrounded by the half-cut portions H14, H15, H16, and H17 for connecting the four sticker portions L3, L4, L5, and L6 to each other is being peeled in advance.

Figure 9C:
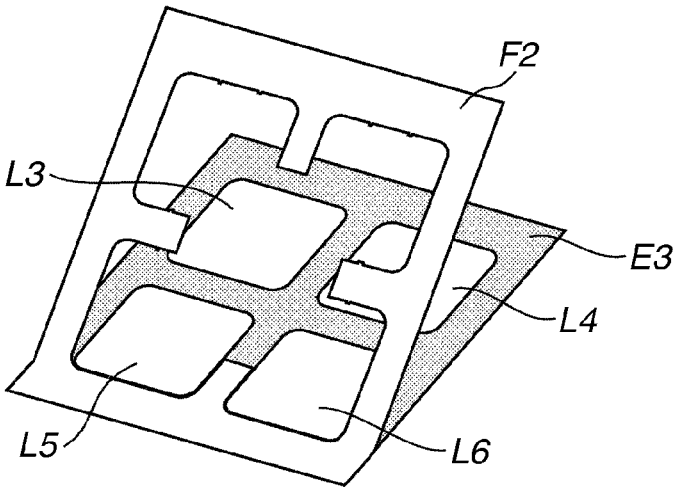

Further, FIG. 9C is a diagram illustrating a state where an outer frame portion F2 of the half-cut portions H14, H15, H16, and H17 for connecting the four sticker portions L3, L4, L5, and L6 to each other is being peeled.

As illustrated in FIGS. 9B and 9C, because the half-cut portions H14, H15, H16, and H17 for connecting each of the sticker portions L3, L4, L5, and L6 are provided, the frame portions F1 and F2 can be peeled in advance of the sticker portions L3, L4, L5, and L6 by making any of the half-cut portions H14, H15, H16, and H17 as a starting point.

After the frame portions F1 and F2 are peeled in advance, only the sticker portions L3, L4, L5, and L6 are left on a release coated paper surface E3, so that the creases will not be formed in the vicinities of the bridge portions B10, B11, B12, and B13 when the sticker portions L3, L4, L5, and L6 are peeled.

In the present exemplary embodiment, the sticker recording sheet having four pieces of sticker portions has been described. However, as long as a plurality of sticker portions such as five pieces, ten pieces, or any number of pieces of sticker portions are formed in the sticker recording sheet, the sticker portions can be similarly joined to each other by the half-cut portions, and thus the same effect can be acquired.

Accordingly, as in the present exemplary embodiment, in the sticker recording sheet including a plurality of sticker portions formed by approximately square-shaped half-cut portions, forming the half-cut portions for connecting the sticker portions to each other can realize the sticker recording sheet on which the creases are not formed when the sticker portions are peeled.

Further, in the present exemplary embodiment, bridge portions B14, B15, B16, and B17 are provided on the approximately center of the half-cut portions H14, H15, H16, and H17 for connecting the stickers L3, L4, L5, and L6 to each other.

By providing the bridge portions on the half-cut portions for connecting each of the sticker portions, it is possible to prevent the sticker portions from being peeled off during the running period.

On the other hand, by providing the bridge portions on the half-cut portions for connecting each of the sticker portions, peeling performance at the beginning of the peeling operation is particularly lowered. Therefore, as in the present exemplary embodiment, the bridge portions are provided on the approximately center of the half-cut portions to make the edge portions of the frame portions be peeled easily.

Figure 11:
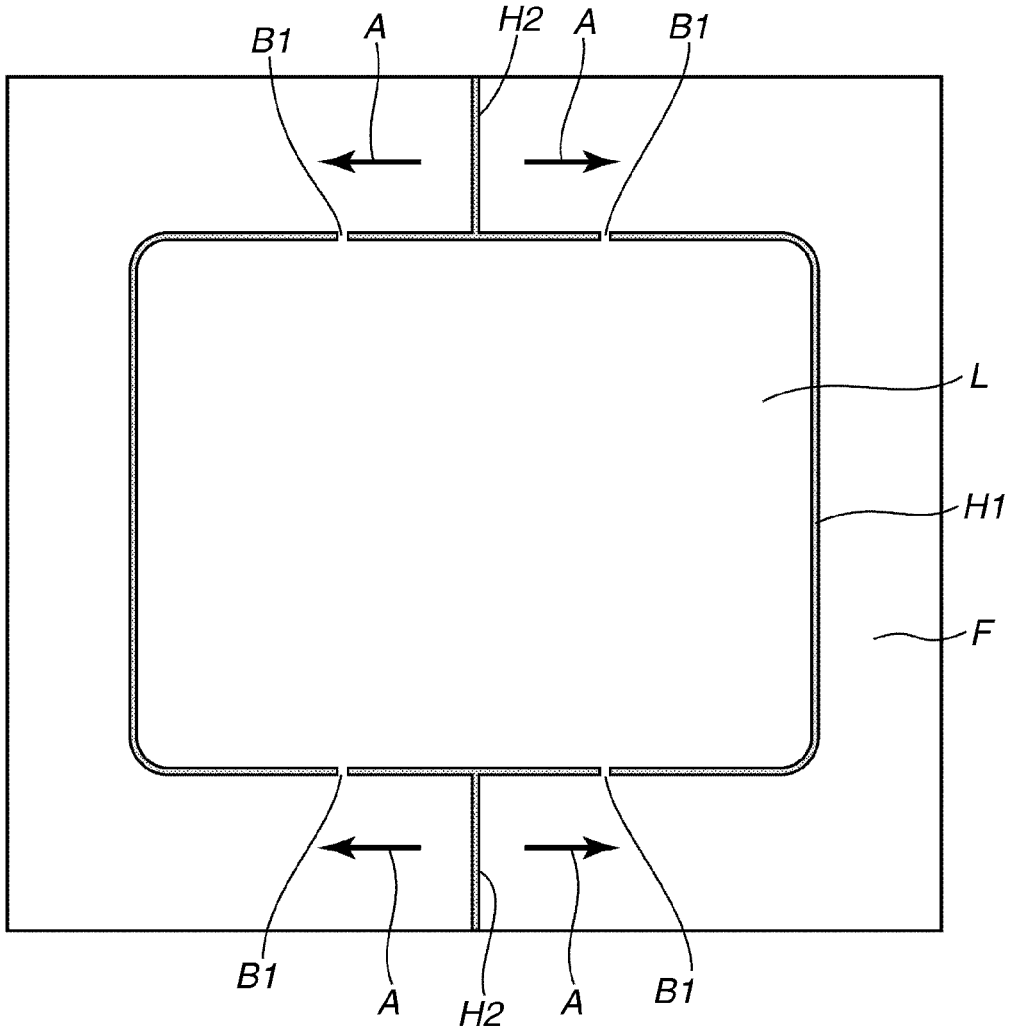
FIG. 11 is a diagram illustrating a sticker recording sheet according to a sixth exemplary embodiment.
Figure 12:
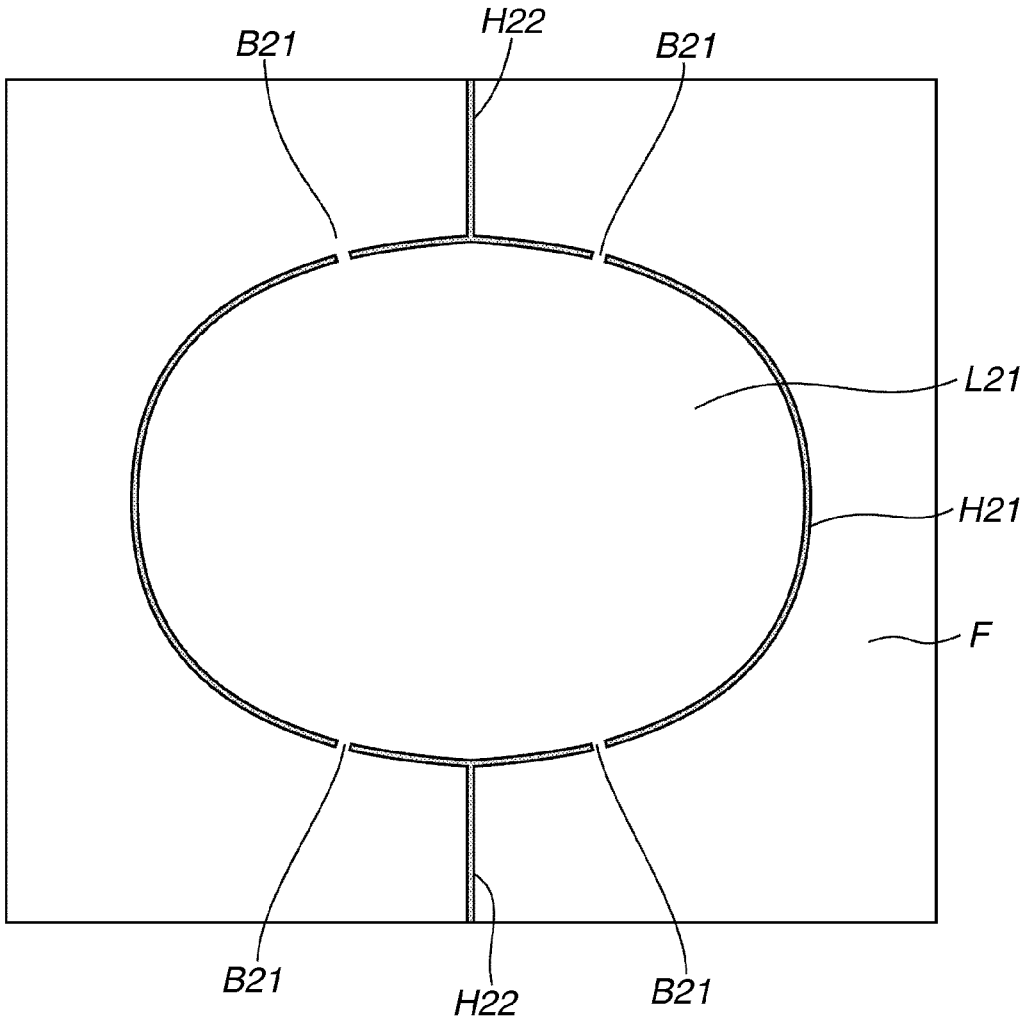
FIG. 12 is a diagram illustrating a sticker recording sheet according to a seventh exemplary embodiment.

A sixth exemplary embodiment will be described with reference to FIG. 11.

A configuration of the sticker recording sheet according to the present exemplary embodiment has basically the same configuration as that of the first exemplary embodiment. In FIG. 11, the same reference numerals are applied to the same configurations as that of the first exemplary embodiment.

In the present exemplary embodiment, arrows A are further printed on the sticker recording sheet. The arrows A are printed on the frame portions F in the vicinities of the half-cut portions H2, on both sides of the half-cut portions H2. Each of the arrows A indicates the direction approximately parallel to the edge of the sticker recording sheet and the half-cut portion H1 located in the vicinity of the arrows A. Each of the arrows A indicates an opposite direction of the half-cut portion H2, the direction for peeling the frame portion F from the half-cut portion H2. Therefore, the user can peel the frame portion F in each of the arrows A directions. As long as the user can understand that the frame portion F can be peeled from the half-cut portion H2, a message, a mark, or an image for notifying the user of the peeling direction can be printed instead of arrows. Further, a message informing the user that the sticker portion can be peeled without being damaged if the frame portion is peeled in advance of the sticker portion may be printed on the frame portion F.

In the first to sixth exemplary embodiments, all of the sticker portions have approximately square shapes. On the contrary, a sticker portion L21 according to a seventh exemplary embodiment has an approximately elliptical shape. In other words, a half-cut portion H21 is formed in an approximately elliptical state, and an uncut bridge portion B21 is provided on a part of the half-cut portion H21.

In addition, a half-cut portion H22 is provided from a cut portion of the half-cut portion H21 toward the outer circumference of the sticker recording sheet.

Therefore, similar to the other exemplary embodiments, by peeling the frame portion F from the half-cut portion H22, the user can peel the sticker portion L21 without damage after peeling the frame portion F.

The exemplary embodiments according to the present invention have been described above. However, the present invention is not limited to the above exemplary embodiments, and various variations and modifications are possible within the scope of the present invention.

Further, each of the exemplary embodiments can be carried out by combining with each other as appropriate.

Furthermore, in the above described exemplary embodiments, the sticker portions having the approximately square shape and the approximately elliptical shape have been described. However, the shape of the sticker portion can be any shape. As long as the half-cut portion for forming the sticker portion is a closed curve state, and the sticker portion is formed by the closed curve with the bridge portion on the closed curve, the present invention can be realized by providing the half-cut portion for connecting a cut position of the closed curve for forming the sticker portion to the outer edge of the sticker recording sheet.

According to the present invention, a high-quality sticker recording sheet, in which a crease or a cut is not formed on a portion of an image-receiving paper portion that is to be used when the image-receiving paper portion is peeled from the release coated paper portion, can be provided.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-132762 filed Jun. 12, 2012, which is hereby incorporated by reference herein in its entirety.

What is claimed is:

1. A sticker recording sheet comprising:

an image-receiving paper portion having a receiving layer, an image-receiving base material, and an adhesive layer laminated on each other; and a release coated paper portion provided on a back surface side of the adhesive layer in a peelable manner, wherein the image-receiving paper portion is provided with:

a first half-cut portion cut in an approximately rectangular shape, having at least one uncut bridge portion formed on at least one side of the rectangular shape; and a second half-cut portion, cut from the at least one side of the rectangular shape having the bridge portion, to an exterior side edge of the image-receiving paper portion, wherein the second half-cut portion is oriented in an approximately perpendicular direction with respect to the at least one side having the bridge portion and the exterior side edge of the image-receiving paper portion, and wherein the second half-cut portion also includes at least one uncut bridge portion.

2. The sticker recording sheet according to claim 1, wherein the sticker recording sheet is a sticker recording sheet for printing an image by a printing apparatus;

wherein the second half-cut portion is cut in a direction parallel to a conveyance direction for conveying the sticker recording sheet by a conveyance roller of the printing apparatus.

3. The sticker recording sheet according to claim 1, wherein two bridge portions are provided on at least one side of the first half-cut portion, and the second half-cut portion is formed from an approximately center of the two bridge portions to the exterior side edge of the image-receiving paper portion.

4. The sticker recording sheet according to claim 1, wherein the uncut bridge portion provided on the second half-cut portion is larger than the uncut bridge portion provided on the first half-cut portion.

5. The sticker recording sheet according to claim 1, wherein the first half-cut portion is provided with two bridge portions respectively on two sides of the rectangular shape parallel to each other, while bridge portions are not provided on other two sides.

6. The sticker recording sheet according to claim 1, wherein the sticker recording sheet is a sticker recording sheet for printing an image by a printing apparatus;

wherein, from among four sides of the rectangular shape of the first half-cut portion, two bridge portions are provided respectively on two sides in a direction parallel to a shaft of a conveyance roller for conveying the sticker recording sheet in the printing apparatus.

7. The sticker recording sheet according to claim 1, wherein, in the first half-cut portion and the second half-cut portion, at least the image-receiving paper portion is cut, whereas a surface of a release coated paper portion which is not adhered to the image-receiving paper portion is not cut.

8. A sticker recording sheet comprising:

an image-receiving sheet portion having a receiving layer, an image-receiving base material, and an adhesive layer laminated on each other; and a release coated paper portion provided on a back surface side of the adhesive layer in a peelable manner, wherein the image-receiving paper portion is provided with:

a first half-cut portion cut in an elliptical shape with at least one uncut bridge portion formed on the elliptical shaped first half-cut portion; and a second half-cut portion, cut from a position on the elliptical shape where the bridge portion of the first half-cut portion is not provided, to an exterior side edge of the image-receiving paper portion, wherein the second half-cut portion is oriented in a direction that intersects a center point of the elliptical shape and perpendicularly with the exterior side edge of the image-receiving paper portion.

* * * * *